United States Patent [19]

Etter

[11] 4,003,806

[45] Jan. 18, 1977

[54] SILVER PLATING BATH

[75] Inventor: Robert William Etter, Lancaster County, Pa.

[73] Assignee: RCA Corporation, New York, N.Y.

[22] Filed: May 30, 1975

[21] Appl. No.: 582,856

[52] U.S. Cl. ..... 204/46 R

[51] Int. Cl.[2] ..... C25D 3/46

[58] Field of Search ..... 204/46 R, 43 R, 109, 204/111

[56] References Cited

UNITED STATES PATENTS.

3,914,161 10/1975 Yonezawa et al. ..... 204/44

FOREIGN PATENTS OR APPLICATIONS 440,591 4/1947 Canada ..... 204/43 R

OTHER PUBLICATIONS

Johannes Fischer et al., "Precious Metal Plating", pp. 12 & 13, (1964).

S. R. Natarajan et al., Metal Finishing, pp. 51–56, Feb. 1971

*Primary Examiner*—G. L. Kaplan

*Attorney, Agent, or Firm*—G. H. Bruestle; D. S. Cohen

[57] ABSTRACT

A solution containing silver iodide, potassium iodide and a calcium salt is an improved silver electroplating bath.

6 Claims, No Drawings

SILVER PLATING BATH

BACKGROUND OF THE INVENTION

The present invention relates to silver electroplating solutions. More particularly, the present invention relates to an improved silver electroplating solution containing silver iodide, potassium iodide and a calcium salt.

The silver plating solutions most widely used are cyanide-containing baths. Although cyanide-containing silver plating baths are economical, they are poisonous and must be operated under controlled conditions. One possible alternative to the standard cyanide electroplating baths is a bath containing silver iodide. The solubility of silver iodide in water is very small, i.e., only about 0.0000028 gram per liter at 25° C. However, silver iodide dissolves readily in strong solutions of potassium iodide. The increase in solubility of the silver iodide is believed to be due to the formation of argentous complexes with potassium and iodide. Silver iodide-potassium iodide solutions readily lend themselves to silver electroplating. An example of a typical silver iodide-potassium iodide electroplating bath is found in U.S. Pat. No. 1,875,664.

Various additives, such as surfactants, e.g. Tergitol NPX (available from Union Carbide Corp., Moorestown, N.J.); brighteners, e.g. ammonium thiosulfate, animal gelatin, dextrin, and naphthalene disulfonic acid; and conductivity enhancers, e.g. sodium nitrate, and potassium nitrate, can be added to the silver iodide-potassium iodide electroplating solution. Surfactants are used as wetting agents to reduce surface tension between the solution and the cathode to be plated. Brighteners, as the name suggests, add lustre to the plating. Conductivity enhancers aid in uniformity of plating. However, experiments with silver iodide-potassium iodide plating solutions, even with various additives, revealed that the electroplated silver was not as adherent, nor as ductile nor as uniform as coatings obtainable from silver cyanide baths.

SUMMARY OF THE INVENTION

The addition of a calcium salt to a silver electroplating bath containing silver iodide and potassium iodide results in an improvement in the uniformity, ductility and adherence of the resultant silver coating.

DETAILED DESCRIPTION OF THE INVENTION

An improved silver electroplating bath comprises a solution of silver iodide, potassium iodide and a calcium salt. Among the calcium salts which can be used are calcium nitrate, calcium iodide, calcium acetate, calcium formate, calcium butyrate, and calcium propionate.

The addition of a calcium salt affects the structure of the electroplated silver grains, i.e., the silver grains deposited on the cathode are smaller than silver grains deposited from baths which do not contain calcium. The decrease in the size of the silver grains lessens the stress in the electroplated silver coating. This results in a silver coating with improved ductility, uniformity, and adherence.

The concentration of the electroplating bath components varies with concentration of the other active components in the bath. The concentration of silver iodide in the typical electroplating solution may vary from about 0.010 mols/liter to about 0.180 mol/liter.

The preferred concentration of silver iodide is about 0.17 mols/liter. The concentration of potassium iodide may vary from about 0.96 mols/liter to about 2.5 mols/liter. The preferred concentration of potassium iodide is about 2.4 mols/liter. The concentration of calcium salt may vary from about 0.12 mols/liter to about 0.20 mols/liter. The preferred concentration of calcium salt is about 0.15 mols/liter. The pH of the electroplating solution may vary from about 5.9 to about 6.5. In addition to the silver iodide, potassium iodide and calcium salt, the electroplating solution may contain varying amounts of additives, such as brighteners, surfactants, and conductivity enhancers, which are previously described and are well known to those skilled in the art.

The following examples of aqueous silver plating baths are given to further illustrate the present invention and are not to be taken in any way restricting the invention beyond the scope of the appended claims.

| | | |
|---|---|---|
| Silver Iodide | 41 gm/liter | (.175 mol/liter) |
| Potassium Iodide | 400 gm/liter | (2.41 mol/liter) |
| Calcium Nitrate | 20 gm/liter | (.122 mol/liter) |
| Sodium Nitrate | 40 gm/liter | |
| Animal Gelatin | 2 gm/liter | |

The above compounds were all mixed in 1 liter of water without any preference in the order of mixing. With a silver anode, a brass cathode and a current density of 0.65 amperes per square foot (7.0 amperes per square meter), an adherent, uniform ductile silver coating was deposited on the brass cathode from this bath after about five minutes.

EXAMPLE II

| | | |
|---|---|---|
| Silver Iodide | 2.5 gm/liter | (.011 mol/liter) |
| Potassium Iodide | 200 gm/liter | (1.20 mol/liter) |
| Calcium Nitrate | 20 gm/liter | (.122 mol/liter) |

The above compounds were all mixed in 1 liter of water without any preference in the order of mixing. With a silver anode, a brass cathode, and a current density of 0.65 amperes per square foot (7.0 amperes per square meter) an adherent, uniform, ductile silver coating was deposited on the brass cathode from this bath after about five minutes.

EXAMPLE III

| | | |
|---|---|---|
| Silver Iodide | 2.5 gm/liter | (.011 mol/liter) |
| Potassium Iodide | 160 gm/liter | (.964 mol/liter) |
| Calcium Nitrate | 20 gm/liter | (.122 mol/liter) |
| Tergitol NPX | 3 drops/liter | |
| Ammonium Thiosulfate (sat. sol.) | 10 drops/liter | |

The above compounds were all mixed in 1 liter of water without any preference in the order of mixing. With a silver anode, a steel cathode, and a current density of 3.6 amperes per square foot (38.8 amperes per square meter), an adherent, uniform, ductile silver coating was deposited on the steel cathode from this bath after about five minutes.

EXAMPLE IV

| | | |
|---|---|---|
| Silver Iodide | 41 gm/liter | (.175 mol/liter) |
| Potassium Iodide | 400 gm/liter | (2.41 mol/liter) |
| Calcium Formate | 16 gm/liter | (.123 mol/liter) |
| Sodium Nitrate | 40 gm/liter | |
| Gelatin-Purified Calfskin | 2 gm/liter | |

The above compounds were all mixed in 1 liter of water without any preference in the order of mixing. With a silver anode, a brass cathode and a current density of 6.82 amperes per square foot (73.4 amperes per square meter), an adherent, uniform, ductile silver coating was deposited on the brass cathode from this bath after about five minutes.

EXAMPLE V

| | | |
|---|---|---|
| Silver Iodide | 41 gm/liter | (.175 mol/liter) |
| Potassium Iodide | 400 gm/liter | (2.41 mol/liter) |
| Calcium Acetate | 21.5 gm/liter | (.136 mol/liter) |
| Sodium Nitrate | 40 gm/liter | |
| Gelatin-Purified Calfskin | 2 gm/liter | |

The above compounds were all mixed in 1 liter of water without any preference in the order of mixing. With a silver anode, a brass cathode and a current density of 7.20 amperes per square foot (86.0 amperes per square meter), an adherent, uniform, ductile silver coating was deposited on the brass cathode from this bath after about five minutes.

What is claimed is:

1. An improved acidic, aqueous silver-electroplating solution containing silver iodide and potassium iodide, wherein the improvement comprises the addition of from about 0.12 mols/liter to about 0.20 mols/liter of a calcium salt to said solution.

2. A silver-electroplating solution of claim 1 wherein said calcium salt is selected from the group consisting of calcium iodide, calcium acetate, calcium formate, calcium butyrate, calcium propionate, and calcium nitrate.

3. In an acidic aqueous silver-electroplating solution containing silver iodide and potassium iodide wherein the concentration of silver iodide is from about 0.010 mols/liter to about 0.180 mols/liter, the concentration of potassium iodide is from about 0.96 mols/liter to about 2.5 mols/liter, the improvement which comprises the addition of from about 0.12 mols/liter to about 0.20 mols/liter of a calcium salt selected from the group consisting of calcium iodide, calcium acetate, calcium formate, calcium butyrate, calcium propionate, and calcium nitrate to said solution.

4. A silver-electroplating solution of claim 3 wherein said solution additionally contains a conductivity enhancer.

5. A silver-electroplating solution of claim 3 wherein said solution additionally contains a surfactant.

6. A silver-electroplating solution of claim 3 wherein said solution additionally contains a brightener.

* * * * *

UNITED STATES PATENT OFFICE

CERTIFICATE OF CORRECTION

PATENT NO. : 4,003,806

DATED : January 18, 1977

INVENTOR(S) : Robert William Etter

It is certified that error appears in the above-identified patent and that said Letters Patent are hereby corrected as shown below:

Col. 1, line 25 change "1,875,664" to --1,857,664--

Col. 2, line 20 insert "EXAMPLE I"

Title Page, Item [56] add --Canadian Patent of Record, pg. 765, April 1, 1947--

Signed and Sealed this

Fifth Day of April 1977

[SEAL]

*Attest:*

RUTH C. MASON
*Attesting Officer*

C. MARSHALL DANN
*Commissioner of Patents and Trademarks*